United States Patent [19]

Hale et al.

[11] Patent Number: 4,512,684

[45] Date of Patent: Apr. 23, 1985

[54] MOBILE OFFSHORE STRUCTURE FOR ARCTIC EXPLORATORY DRILLING

[75] Inventors: David R. Hale, Elmhurst; William A. Owen, Lombard; James A. Orndorff, Jr., Glen Ellyn, all of Ill.

[73] Assignee: CBI Offshore, Inc., Oak Brook, Ill.

[21] Appl. No.: 503,703

[22] Filed: Jun. 13, 1983

[51] Int. Cl.[3] ..... E02B 15/02

[52] U.S. Cl. ..... 405/217; 405/195; 405/210

[58] Field of Search ..... 405/217, 196, 197, 198, 405/199, 200, 207, 205, 208, 203, 204

[56] References Cited

U.S. PATENT DOCUMENTS

| | | | |
|---|---|---|---|
| 2,327,118 | 8/1943 | MacKnight | 405/207 |
| 2,534,480 | 12/1950 | Shannon | 405/203 X |
| 2,589,153 | 3/1952 | Smith . | |
| 2,652,693 | 9/1953 | Goldman et al. | 405/208 |
| 2,941,369 | 6/1960 | Quirin | 405/200 |
| 3,433,024 | 3/1969 | Diamond et al. | 405/196 |
| 3,791,152 | 2/1974 | Davis et al. . | |
| 3,828,565 | 8/1974 | McCabe . | |
| 3,972,199 | 8/1976 | Hudson et al. | 405/217 |
| 4,209,271 | 6/1980 | McCabe et al. . | |
| 4,334,802 | 6/1982 | Dysarz | 405/196 |
| 4,382,419 | 5/1983 | Drimmelen et al. | 114/40 X |

*Primary Examiner*—Dennis L. Taylor

*Attorney, Agent, or Firm*—Marshall, O'Toole, Gerstein, Murray & Bicknell

[57] ABSTRACT

An offshore exploratory drilling floatable structure ballastable to rest on a sea floor but to extend above water level when so supported and adapted to withstand arctic ice loads, comprising a substantially vertical wall capable of withstanding arctic ice loads; a structural load bearing bottom rigidly connected to a lower portion of the wall; and a floatable vertically displaceable load bearing structural deck inside the wall.

18 Claims, 8 Drawing Figures

MOBILE OFFSHORE STRUCTURE FOR ARCTIC EXPLORATORY DRILLING

This invention relates to offshore structures used for exploratory drilling for oil and gas. More particularly, this invention is concerned with an offshore structure, adapted to withstand arctic ice loads, which can be floated into position in shallow water and then be ballasted to rest on the sea floor.

BACKGROUND OF THE INVENTION

To drill in the shallow waters (less than 100 feet depth) of the outer continental shelf off Alaska year-round, new types of exploratory drilling structures are needed. This is mainly because of the enormous environmental loads imposed on drilling structures by sea ice conditions during the winter months and during summer break-up. The ice loadings will generally exceed normal offshore structure design loadings, such as storm wave conditions. As a consequence, structures designed to operate under these conditions will tend to be more massive and structurally stronger than conventional offshore exploratory structures.

In addition to remaining structurally intact during operations in sea ice conditions, the drilling structure must remain stationary, on site, during these same conditions. Thus, the structure must have little or no horizontal movement when subjected to ice loadings. To accomplish this, it must transfer the substantial horizontal ice loads to some sort of foundation, typically the sea floor. For shallow water depths, this can usually be accomplished by load transfer between the structure and the foundation by two main means. The first involves frictional load transfer between the structure and foundation. It relies on the horizontal shear resistance to keep the structure sited. The second involves mechanical means of load transfer through the use of piles driven into the sea floor. The piles absorb the load from the structure and then transfer it into the sea floor. A third possible variation involves the use of both friction and piles to effect load transfer.

Several of the above factors combine to complicate oil exploration in arctic regions where many of the most promising sites lie under relatively shallow water. The same shallow water sites are also invaded by drifting ice features that will apply very large lateral loads to a stationary sea surface-protruding structure.

It is also possible that these loads could be applied to the structure at any time of the year. It is therefore desirable to have a structure which can be installed and brought up to full strength quickly. Piles could be used to provide a significant portion of the total strength requirement but they take a relatively long time to install, so there is a danger that a pile-retained structure may be subjected to an ice load before it is completely "up to strength".

As an alternative, the structure could be ballasted with a high density material such as iron ore or gravel, but iron ore is not locally available at all and gravel is relatively scarce in many arctic regions. Either one of these materials would have to be transported in large quantities over distances greater than 100 miles. This becomes prohibitively expensive in an arctic environment. They also require substantial amounts of time and effort to put in place or remove to refloat the structure.

In general, an offshore structure for drilling exploratory wells in shallow ice-covered waters, such as arctic waters, desirably meets many, if not all, of the following criteria:

1. The structure should have a draft as shallow as possible in the lightship condition. This would allow the structure to operate in water depths as shallow as possible, thus maximizing its operational versatility.

2. The structure should utilize an abundant, cheap, readily available ballast material. This would minimize problems relating to the use and acquisition of often scarce, expensive ballast materials.

3. The structure should have the ability to move onto site, take on ballast and be ready for drilling operations to begin, and resist environmental ice loadings, as soon as possible. Similarly, the structure should be able to de-ballast, pick-up and be able to move offsite in a time period as short as possible. This would allow for a move to a different site during the short summer season in the target region.

4. The structure should have the ability to conduct normal drilling operations year-round. Due to large periods of complete ice cover in target areas, this would necessitate that the structure be able to store sufficient quantities of drilling material and supplies to allow continuous operation for extended periods of time, as up to 270 days, without major resupply of the structure.

5. Based on the above requirement for large amounts of drilling consumables, the structure should have a large storage capacity for such materials. Since several of these items are quite bulky and heavy, the structure must provide sufficient space and structural load-carrying capacity to store these materials.

6. The structure should minimize any necessary site preparation and alteration. This will reduce the extent of expensive, slow offshore foundation work and cause the least possible adverse impact to the existing environment. By reducing foundation preparation requirements, the use of expensive, scarce materials such as gravel and sand typically used for this purpose is minimized.

SUMMARY OF THE INVENTION

According to the invention there is provided an offshore exploratory drilling floatable structure ballastable to rest on a sea floor but to extend above water level when so supported and adapted to withstand arctic ice loads, comprising a substantially vertical wall means capable of withstanding arctic ice loads; a structural load bearing bottom rigidly connected to a lower portion of the wall means; and a floatable vertically displaceable load bearing structural deck inside the wall means.

The offshore structure will most always include a heater means for heating a liquid ballast, in the space defined by the wall means and the bottom, used to increase the weight of the structure resting on a sea floor site.

The offshore structure will generally include a moonpool-forming vertical shell which extends entirely through, and is connected to, the structural bottom. A hole is provided in the deck so that the moonpool-forming shell can project through it loosely. A drilling derrick, supported by the structure so as to drill through the moonpool, is usually provided for exploratory drilling.

More specifically, the invention provides an offshore exploratory drilling floatable structure ballastable to rest on a sea floor but to extend above water level when so supported and adapted to withstand arctic ice loads comprising a wall means having an outer vertical cylindrical, desirably substantially circular, shell, and an inner vertical cylindrical, desirably substantially circular, shell; the inner shell being positioned radially inwardly of the outer shell with the inner and outer shells having a common vertical axis thereby defining an annular space of uniform width between the inner and outer shells; reinforcing means, in the annular space, extending between the inner and outer shells in the lower portion thereof which may be subjected to arctic ice loads when the structure rests on a sea floor; a structural load bearing bottom having a pair of substantially equally spaced apart horizontal upper and lower discs connected to the wall means and with the lower disc and lower end of the wall means being about in the same plane; a structural load bearing means between and connecting the upper and lower discs together; and a floatable vertically displaceable substantially horizontal circular load bearing structural deck inside of and having a diameter slightly less than the inner shell.

The space between the upper and lower discs can be substantially void. Means to feed liquid ballast to the void and remove it therefrom to deballast the structure are desirably included.

The annular space between the inner and outer shells of the wall means can be partially or substantially void, and means provided to feed liquid ballast to the annular space and remove it therefrom to deballast the structure. However, if desirable, the annular space between the inner and outer shells of the wall means can be partially or fully insulated to retard heat loss from any liquid placed in the structure, beneath the deck, to the sea around the outside of the wall means.

Means is also included to fill the offshore structure space defined by the upper disc and the inner shell with a liquid to float the deck to near the top of the inner shell. Mechanical means could be included to support the deck near the top of the inner shell after it is floated into said position.

The bottom will generally have an overall height which is at least 20% of the overall height of the wall means to provide the desired strength against ice loads.

A heater means for heating a liquid in the space defined by the lower disc and the inner shell, with the deck near the top of the inner shell, is usually included to prevent the liquid from solidifying, particularly when water is the liquid, when the structure is in a cold environment.

A moonpool-forming vertical cylindrical shell extending entirely through and connected to the structure bottom is generally provided to facilitate drilling. To permit the deck to move vertically a hole can be provided in the deck through which the moonpool-forming shell can project so that the deck can slide or telescope relative to the shell. The moonpool-forming shell is preferably circular in horizontal section and has a vertical axis.

Skirt means could be connected to the lower surface of the lower disc and extend vertically downwardly to further aid in restricting horizontal movement of the structure once it is positioned on a sea floor site.

DETAILED DESCRIPTION OF THE DRAWINGS

To the extent it is reasonable and practical the same or similar elements or parts which appear in the various views of the drawings will be identified by the same numbers.

Figure 1:
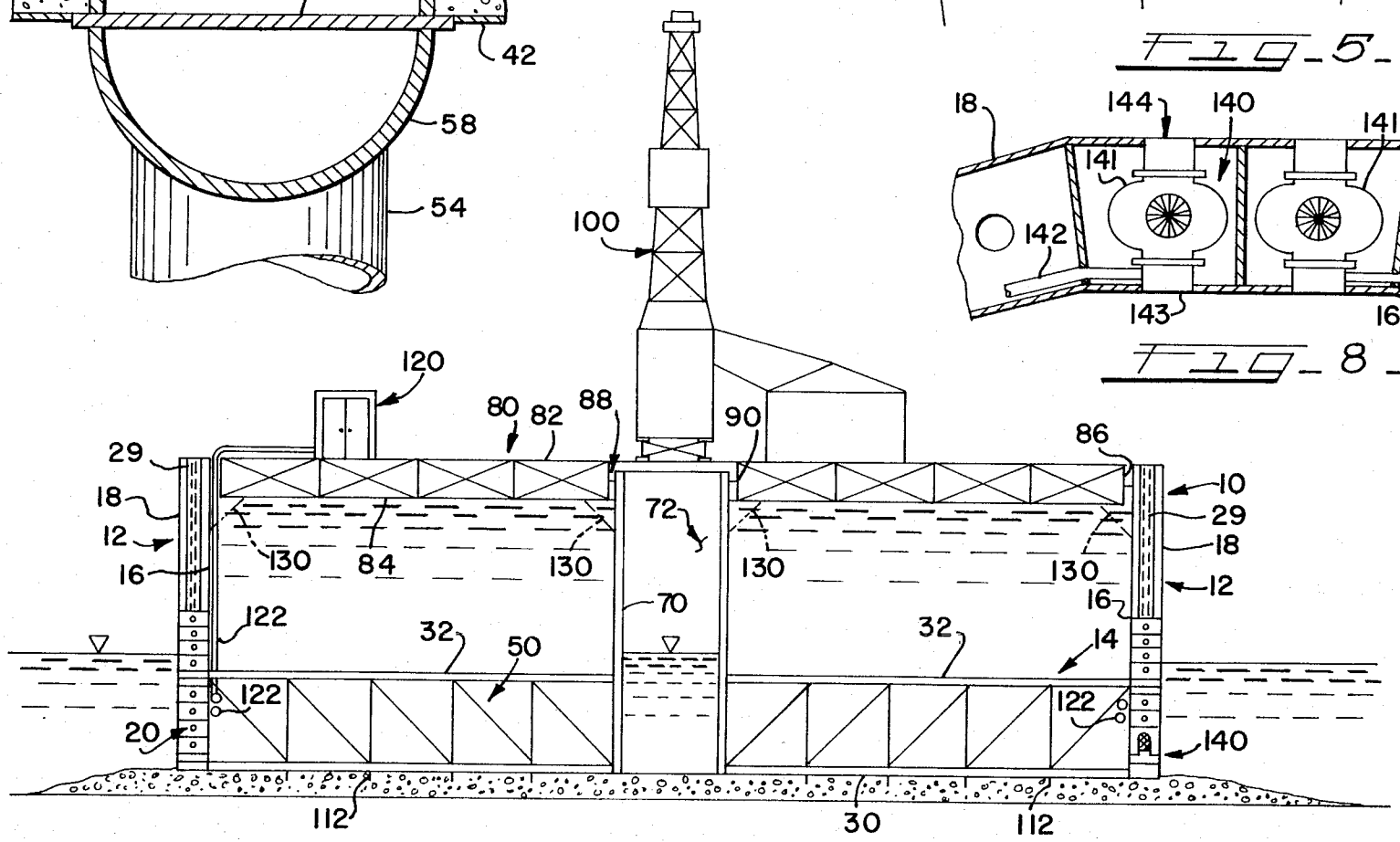
FIG. 1 is a vertical sectional view of an offshore structure, according to the invention, on site supported by the sea floor.
Figure 2:
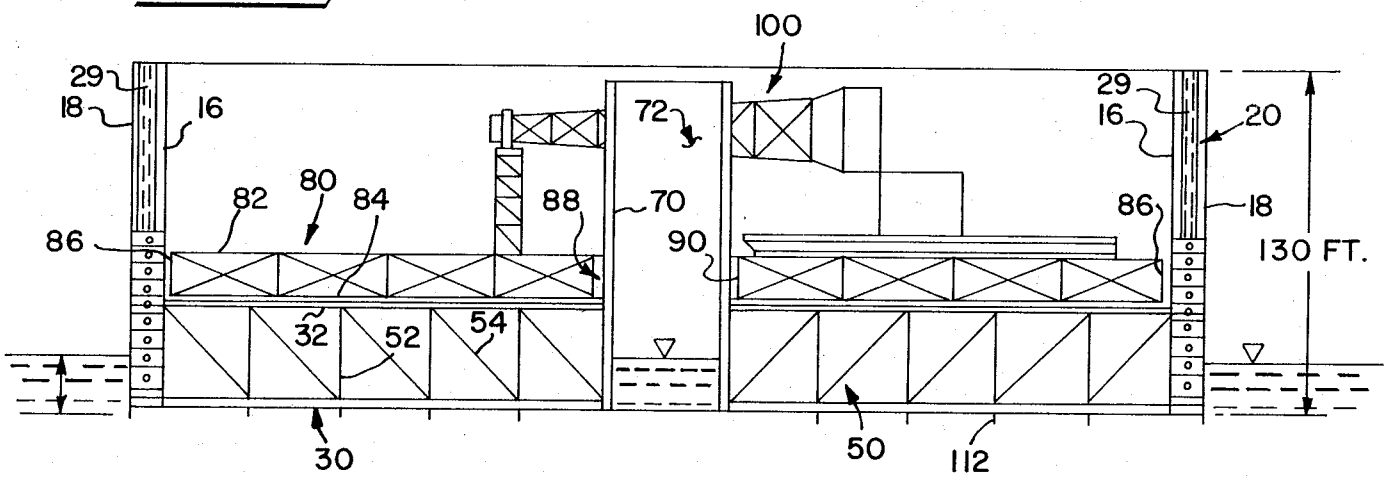
FIG. 2 is a ver sectional view of the offshore structure of FIG. 1. with some draft.
Figure 3:
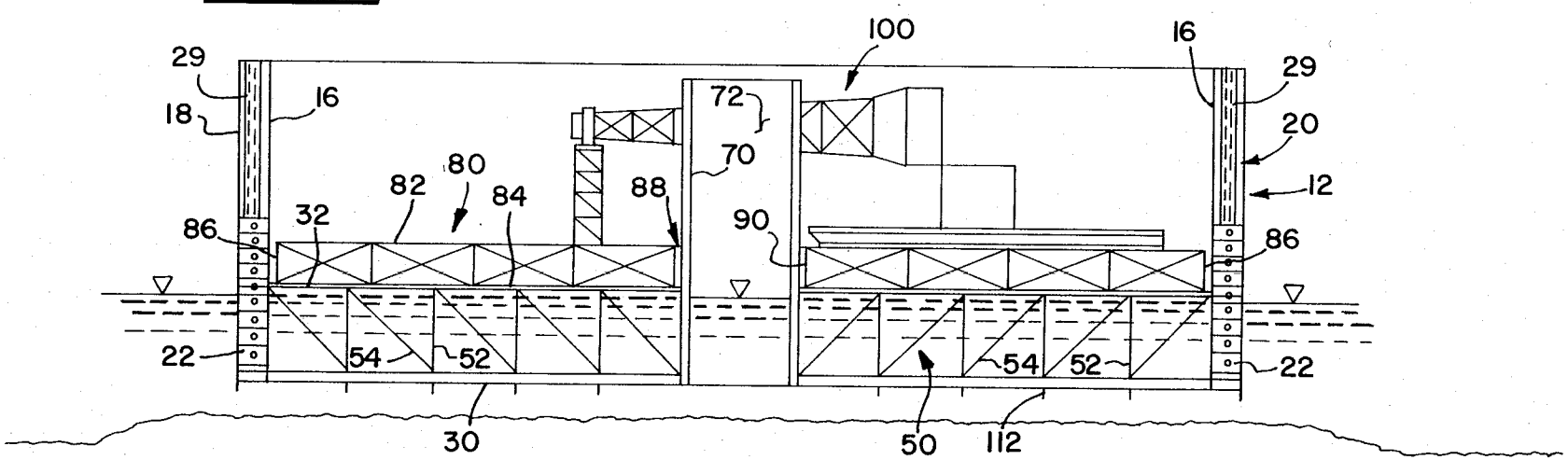
FIG. 3 is a vertical sectional view of the offshore structure of FIG. 1 partially ballasted as it is lowered to the sea floor.

With reference to FIGS. 1 to 3, the offshore structure 10 has a vertical cylindrical substantially circular wall 12 connected to bottom 14. Wall 12 has an inner vertical cylindrical substantially circular shell 16 and an outer vertical cylindrical substantially circular shell 18 spaced apart from the inner shell. The inner and outer shells 16, 18 have a common axis, the result being that they define an annular space 20 between them. The top and bottom ends of the annular space 20 are closed by structural means. The shells 16, 18 can be metal shells, or any possible combination of metal and concrete.

Figure 5:
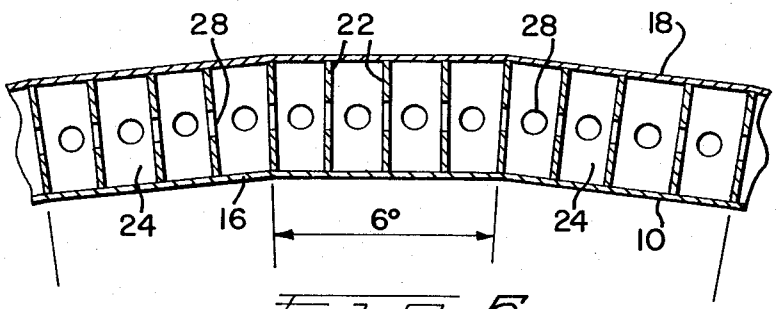
FIG. 5 is a sectional view taken along the line 5—5 of FIG. 4.
Figure 4:
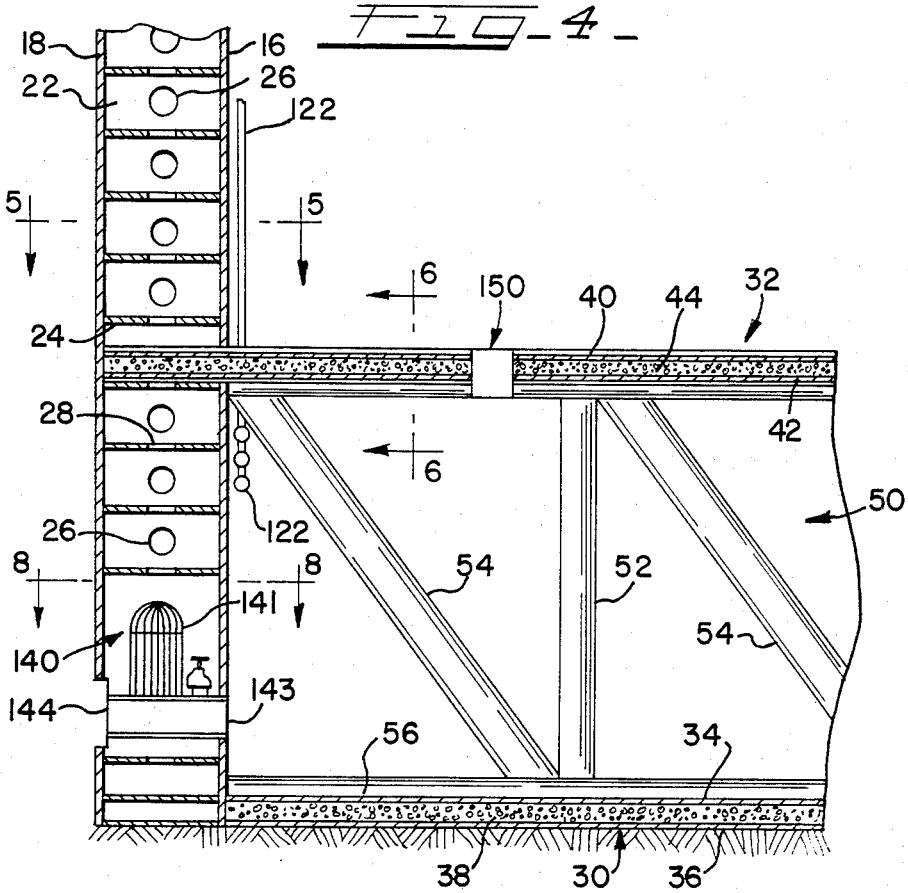
FIG. 4. is an enlarged partial vertical sectional view of a wall and bottom portion of the offshore structure shown in FIG. 1

The lower portion of wall 12 which is calculated to extend from a sea floor site to above sea level and to be subjected to ice loadings is reinforced or strengthened by providing a plurality of substantially parallel vertical spaced apart plates 22, and a plurality of substantially parallel horizontal spaced apart plates 24 in annular space 20. The ends of plates 22 and 24 are desirably connected to the inner surfaces of inner and outer shells 16, 18. Each vertical plate 22 contains an access hole 26 (FIG. 4). Similarly, each horizontal plate 24 contains an access hole 28 (FIG. 5). The holes 26 and 28 provide means for ballast communication throughout the annular space. However, it may be desirable for controlled ballasting and deballasting to divide the annular space into liquid tight chambers which can be filled and emptied of liquid at will for controlled immergence and refloating of the structure.

To retard heat flow through the wall 12, thermal insulation 29 can be contained within the annular space (FIGS. 1 to 3).

The bottom 14 (FIGS. 1 to 4) includes a horizontal lower disc 30 and an upper horizontal disc 32. The lower disc 30 has its bottom surface in the same plane as the bottom or lower end of wall 12.

The lower disc 30 is a composite of spaced apart top and bottom horizontal plates 34, 36 between which a layer of possibly reinforced concrete 38 is positioned (FIG. 4). Similarly, upper disc 32 is a composite of spaced apart top and bottom horizontal plates 40, 42 between which a layer of concrete 44, possibly reinforced, is positioned.

Figure 6:
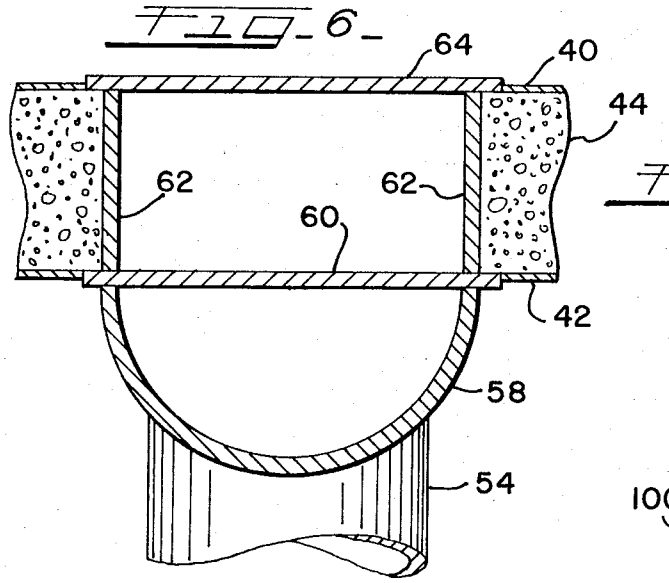
FIG. 6 is a sectional view taken along the line 6—6 of FIG. 4.

A structural truss or framework 50 (FIGS. 1 and 6) is located between and joined to discs 30, 32. Framework 50 includes vertical structural members 52 and angled structural members 54. The ends of structural members 52, 54 are connected to elongated members 56, 58 connected to heavy metal plates 60 in each disc. As shown in FIG. 6, plate 60 is connected to vertical webs 62 which are connected to top plate 64 located at the top of upper disc 32. A similar arrangement is located in the lower disc 30 to connect the truss to it. It should be understood that a plurality of truss arrangements as described are used to interconnect the discs.

Extending completely through the bottom 14 is a vertical cylindrical shell 70 which defines a moonpool 72. The shell 70 desirably is circular in horizontal section. Shell 70 is desirably located concentric to wall 12 (FIGS. 1 to 3). However, it is not essential that shell 70 be concentrically located as described and illustrated in the drawings. Thus, some users of the structure may prefer to have the shell 70 located closer to wall 12.

A load bearing structural deck 80 is located inside the offshore structure (FIGS. 1 to 3). The deck is generally circular with spaced apart top and bottom horizontal plates 82, 84 and a vertical peripheral rim 86 connected to plates 82, 84. Deck 80 contains a vertical hole 88 defined by vertical rim plate 90 which is joined to plates 82, 84. Hole 88 is slightly larger than the diameter of moonpool defining shell 70 so as to permit the deck to move or slide up and down relative to the shell. Furthermore, the overall diameter of deck 80 is slightly less than the inner diameter of wall 12 so that the deck can move vertically relative to the wall.

Figure 7:
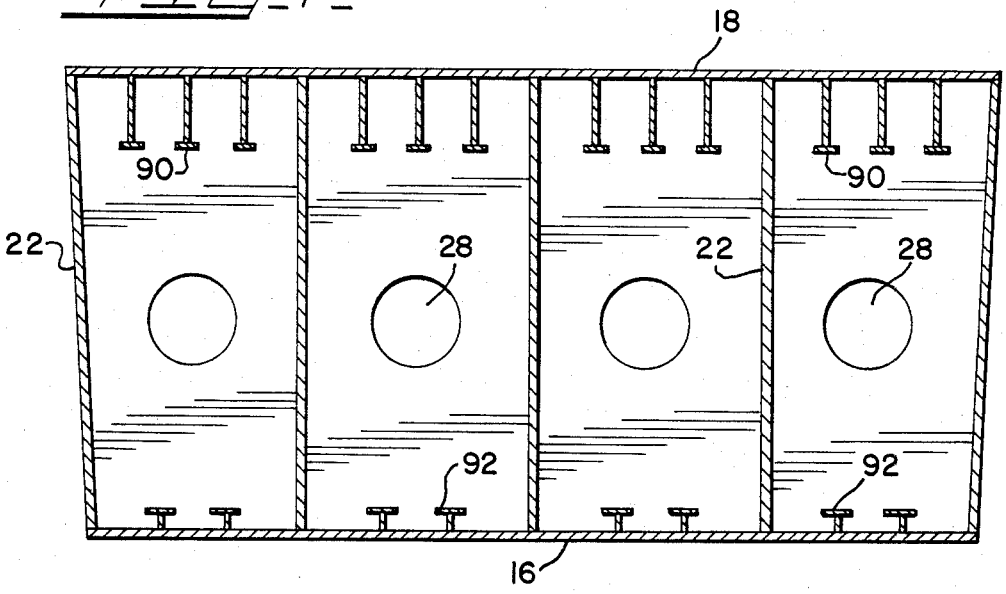
FIG. 7 is an enlarged partial view of FIG. 5.

With reference to FIGS. 5 and 7, the wall 12 while substantially circular is actually shown as a sixty sided polygon having the inner 16 and outer 18 shells parallel to each other. The inner and outer shells can be stiffened by T-sections 90, 92 to better withstand and transfer the loads to which they will be subjected (FIG. 7).

FIG. 2 illustrates the described offshore structure 10 floating with some draft in an essentially deballasted condition. A drilling derrick 100 has been positioned on deck 80 preparatory to towing the offshore structure to a site. At this time, deck 80 rests on the structure bottom 14.

Once the offshore structure arrives at the site where it is to be located, ballasting of the structure begins. The bottom 14 is ballasted by filling the void space therein with sea water. Similarly, the reinforced lower portion of wall 12 could be ballasted with sea water. As such ballasting proceeds the offshore structure will be lowered into the water as shown in FIG. 3. Then further ballasting is effected by feeding sea water into the space above bottom 14 and below deck 80. The ballasting will cause bottom 14, having vertical skirt elements 112 extending downwardly from the outer surface thereof, to descend until it rests on the prepared foundation on the sea floor. At this stage, the water level in the structure will be the same as sea level and the deck will be floating at that level. To increase the downward bearing force applied by the offshore structure to the foundation, additional sea water is fed to the structure to raise the water level beneath deck 80 until the internal water level is near the top of wall 12. At that point, deck 80 floats near the top of wall 12 as shown in FIG. 1.

Figure 8:
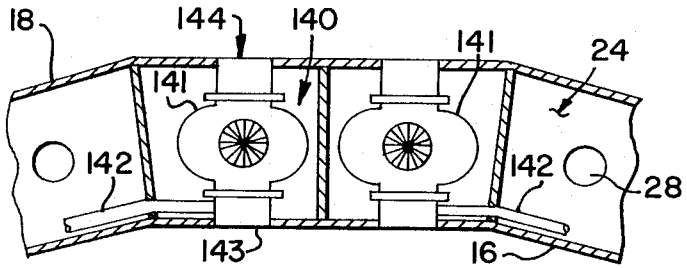
FIG. 8 is a sectional plan view of the ballast inlet and pump configuration.

To effect the aforementioned ballasting operation, sea water is drawn from outside the structure through inlet 144 into pump 141 (FIGS. 1, 4 and 8) located in pump chamber 140. During initial immergence, ballast water is introduced simultaneously into the wall annular space 20 and bottom void 14 by means of pipe 142 and outlet 143. After the structure has been lowered to the sea floor and the annular space has been flooded to sea level, no further ballast is added to the annular space 20. However, ballast addition continues into the bottom void so that water passes through port 150 in upper disc 32 into the space beneath deck 80 causing the deck to float and rise to the level shown in FIG. 1.

Heating unit 120 provides heated fluid to closed loop coils 122. In this way the water is prevented from freezing during cold weather. Furthermore, if desired, thermal insulation can be placed in and/or over the space between wall 12 and the rim of deck 80, and in the deck, to retard heat loss.

While the deck 80 can usually be permitted to float freely in the structure as shown in FIG. 1, it may be desirable at times to detachably support the deck on load bearing supports 130 joined to wall 12 and moonpool shell 70.

After the offshore structure is in position on site as described, derrick 100 is moved into position over the moonpool 72 to commence drilling.

EXAMPLE

A specific offshore structure such as illustrated by FIG. 1 can have an outside diameter of 400 feet, an inner diameter of 380 feet, a wall height of 130 feet, a bottom vertical height of 45 feet, a deck height of 15 feet, a moonpool inner diameter of 40 feet and a stiffened or reinforced wall of 70 feet measured from the bottom. Such a structure can be used in arctic waters which are about 20 to 50 feet deep.

The offshore structure is towed into position at one offshore site with the deck resting on the structure bottom. Then the structure bottom between the lower and upper discs is ballasted with sea water. Similarly, the annular space between the inner and outer shells of the wall is ballasted with sea water. This is generally adequate to lower the structure to the sea floor. Then sea water is fed to the space defined by the structure bottom and wall to float and raise the deck to near the top of the structure wall. Not only does the sea water float the deck but the water ballast is raised to a level above the sea surface so as to develop the necessary weight to resist horizontal ice loads. Specifically, the water level in the structure can be brought to about 10 feet from the top of the wall. Since sea water is readily available, it provides an inexpensive ballast material and one which can be added and removed rapidly and easily. It also provides an efficient and inexpensive means of supporting a large deck or drilling platform which can also store the needed drilling equipment and supplies.

Major lateral ice loadings on the exterior wall of the structure will be withstood by the stiff, strengthened outer wall extended 70 feet above the wall bottom. This wall serves two purposes: (1) to withstand the ice loadings and facilitate transfer of them to the foundation, and (2) act as a water-retaining membrane to hold the additional ballast water above sea level. This 70 feet tall section of wall is extended high enough to resist major horizontal ice loading applied to the structure. The extension above this wall section is a continuation of the two discrete inner and outer cylindrical shells. The upper inner shell acts as a water retention membrane, while the upper outer shell provides additional environmental protection as well as a space in which an insulating material may be located to reduce heat transfer from inside the structure to the ice and sea around the structure.

To assure that the seawater ballast remains liquid in arctic conditions, a ballast water heating system is incorporated into the structure. In conjunction with this heating system, the structure has the exterior sections, which are exposed to outside temperatures, sufficiently insulated to minimize heating requirements and to prevent ice formation within the ballast water.

To transfer horizontal ice loadings into the foundation, the structure has a structural load-carrying bottom which includes two flat discs tied together by a structural framework such that the two discs efficiently act together as flanges of a deep beam. Thus, they become load-carrying members, and act to transfer load carried by them to other sections of the structure. This distribution of load across the structure is important for fairly uniform distribution of foundation shear resistance to the imposed ice loadings.

The actual load transfer of these ice loads into the sea floor is complicated, but basically, acts in two ways. Because of the rigidity of the wall outer shell and the rounding effect that the two bottom discs have on the vertical cylinder, some horizontal load transfer is accomplished through the distribution of circumferential shear forces around the circumference of the outer wall, then into the bottom disc. The other portion of the ice load will go directly into the top disc, to be carried and distributed through the top disc and into the bottom disc through the structural framework connecting the two discs.

The floating deck during drilling operations will be quite stable. Because of the enclosed environment of the ballast water that supports the deck, the deck will essentially act like a standard drilling barge used in shallow water areas. The deck will always float at one height for safety and operational considerations. To maintain level trim of the deck during operation, a variable ballast trim system can be incorporated into the deck. This will be used to offset substantial lateral weight shifts to ensure a level drill platform. The size and load-carrying capacity of the deck is such that it can store sufficient drilling consumables for three, 14,000 feet deep wells and 270 continuous days of operation without major resupply.

Drilling from the floating deck can be accomplished through the integral moonpool that penetrates both the deck and the bottom structure. The moonpool is defined by a watertight shell or membrane. It can house the required number of drilling slots and possibly act to transfer loads from the drill derrick to the bottom structure. The deck can translate vertically along the moonpool shell exterior surface during ballasting and deballasting operations.

The lightship draft of the structure is shallow enough to allow access to sites having water depths as shallow as 20 feet. Upon reaching the desired drilling site, the structure is flooded until settled on the sea floor, then additional ballast water is added until the deck reaches operational height. The structure can be designed to accomplish this within 48 hours after site arrival. Thus, it may be raised, transported, and sited on a new location within the very short ice-free summer season in arctic regions. To aid deballasting operations, a jetting system to aid in breaking the suction bond between structure and foundation can be incorporated. This system can utilize high-pressure water jets to eliminate the adhesive bond between the structure bottom and the sea floor.

The foregoing detailed description has been given for clearness of understanding only, and no unnecessary limitations should be understood therefrom, as modifications will be obvious to those skilled in the art.

What is claimed is:

1. An offshore exploratory drilling floatable structure ballastable to rest on a sea floor but to extend above water level when so supported and adapted to withstand arctic ice loads, comprising:

a wall means having an outer substantially vertical cylindrical shell and an inner substantially vertical cylindrical shell;

the inner shell being positioned radially inwardly of the outer shell with the inner and outer shells having a common vertical axis thereby defining an annular space between the inner and outer shells;

reinforcing means, in the annular space, extending between the inner and outer shells in the lower portion thereof which may be subjected to arctic ice loads when the structure rests on a sea floor;

a structural load bearing bottom having a pair of substantially equally spaced apart horizontal upper and lower discs connected to the wall means;

a structural load bearing means between and connecting the upper and lower discs together; and a floatable vertically displaceable substantially horizontal circular load bearing structural deck inside of and having a diameter slightly less than the inner shell.

2. An offshore structure according to claim 1 in which the space between the bottom upper and lower discs is substantially void, and including means to feed liquid ballast to the void and remove it therefrom.

3. An offshore structure according to claim 1 in which the annular space between the inner and outer shells of the wall means is substantially void, and including means to feed liquid ballast to the annular space void and remove it therefrom.

4. An offshore structure according to claim 1 in which the annular space between the inner and outer shells of the wall means is at least partially insulated to retard heat loss from any liquid placed in the structure.

5. An offshore structure according to claim 1 including means to fill the offshore structure space defined by the upper disc and the inner shell with a liquid to float the deck near the top of the inner shell.

6. An offshore structure according to claim 5 including mechanical means to support the deck near the top of the inner shell after it is floated into said position.

7. An offshore structure according to claim 1 in which the bottom has an overall height which is at least 20% of the height of the wall means.

8. An offshore structure according to claim 5 or 6 including a heater means for heating a liquid in the space defined by the lower disc and the inner shell with the deck near the top of the inner shell.

9. An offshore structure according to claim 1 including a moonpool-forming vertical cylindrical shell extending entirely through and connected to the structure bottom and a hole in the deck through which the moonpool-forming shell projects.

10. An offshore structure according to claim 9 in which the moonpool-forming shell is circular in horizontal section and has a vertical axis.

11. An offshore structure according to claim 1 in which skirt means are connected to the lower surface of the lower disc and extend downwardly.

12. A method of providing an offshore structure supported by a sea floor in an arctic environment site in which the sea is covered by ice loads during a substantial portion of a year, comprising:

producing, at a location remote from the site where the structure is to be located, a floatable structure ballastable to rest on a sea floor but to extend above water level when so supported and adapted to withstand arctic ice loads, said structure having a substantially vertical wall means capable of withstanding arctic ice loads; a structural load bearing bottom rigidly connected to a lower portion of the wall means; and a floatable vertically displaceable load bearing structural deck inside the wall means supported by the bottom;

floatably transporting the floatable structure to an arctic site subjected to ice loads but which is substantailly free of ice during such transport;

after arrival at the site, ballasting the structure by feeding liquid ballast to the space defined by the bottom and wall means until the bottom rests on the sea floor and the liquid level in the structure is below the top of the wall means and floatably supports the deck substantially above sea level; and the amount of liquid ballast plus the weight of the structure being sufficient to provide resistance against horizontal movement when the structure is subjected to ice loads.

13. A method according to claim 12 in which the liquid ballast is water and it is heated to prevent it from freezing in the structure.

14. A method according to claim 12 in which the offshore structure includes a moonpool-forming vertical shell extending entirely through, and connected to, the structural bottom, and a hole in the deck through which the moonpool-forming shell projects thereby permitting vertical displacement of the deck relative to the bottom.

15. A method according to claim 12 in which the offshore structure wall means has an outer substantially vertical cylindrical shell and an inner substantially vertical cylindrical shell; the inner shell is positioned radially inwardly of the outer shell; the inner and outer shells have a common vertical axis thereby defining an annular space between the inner and outer shells; reinforcing means, in the annular space, extending between the inner and outer shells in the lower portion thereof which may be subjected to arctic ice loads when the structure rests on the sea floor; the structural load bearing bottom has a pair of substantially equally spaced apart horizontal upper and lower discs connected to the wall means; and a structural load bearing means is between and connects the upper and lower discs together; and during ballasting of the structure at the arctic site the annular space is filled with liquid ballast at least up to sea level, and any void between the upper and lower discs is filled with liquid ballast.

16. An offshore structure according to claim 1 in which the vertical wall means includes means by which it can be ballasted and deballasted with liquid.

17. An offshore exploratory drilling floatable structure ballastable to rest on a sea floor but to extend above water level when so supported and adapted to withstand arctic ice loads, comprising:

a substantially vertical wall means capable of withstanding arctic ice loads;

the vertical wall means including means by which it can be ballasted and deballasted with liquid;

a structural load bearing bottom rigidly connected to a lower portion of the wall means; and a floatable vertically displaceable load bearing structural deck inside the wall means.

18. An offshore exploratory drilling floatable structure ballastable to rest on a sea floor but to extend above water level when so supported and adapted to withstand arctic ice loads, comprising:

a substantially vertical wall means capable of withstanding arctic ice loads;

a structural load bearing bottom rigidly connected to a lower portion of the wall means;

the structural load bearing bottom including means by which liquid ballast can be added to the bottom and removed therefrom;

a floatable vertically displaceable load bearing structural deck inside the wall means; and means to feed liquid into the offshore structure space defined by the deck means, bottom means and wall means to float the deck and ballast the offshore structure and means to remove the liquid from the space to deballast the offshore structure.

* * * * *

UNITED STATES PATENT AND TRADEMARK OFFICE

CERTIFICATE OF CORRECTION

PATENT NO. : 4,512,684

DATED : April 23, 1985

INVENTOR(S) : DAVID R. HALE ET AL

It is certified that error appears in the above-identified patent and that said Letters Patent is hereby corrected as shown below:

Column 3, line 67, change "ver" to -- vertical --;

column 8, line 29, after "claim 1" insert -- or 2 --;

column 9, line 12, change "stantailly" to -- stantially --;

column 10, line 10, change "claim 1" to -- claim 18 --.

Signed and Sealed this

*Twenty-seventh* Day of *August 1985*

[SEAL]

*Attest:*

DONALD J. QUIGG

*Attesting Officer*

*Acting Commissioner of Patents and Trademarks*